US010131138B2

(12) United States Patent
Bonner

(10) Patent No.: US 10,131,138 B2
(45) Date of Patent: Nov. 20, 2018

(54) DECORATOR INKER STATION TEMPERATURE CONTROL SYSTEM

(71) Applicant: St. Clair Systems, Inc., Romeo, MI (US)

(72) Inventor: Michael Bonner, Rochester Hills, MI (US)

( * ) Notice: Subject to any disclaimer, the term of this patent is extended or adjusted under 35 U.S.C. 154(b) by 0 days.

(21) Appl. No.: 13/621,549

(22) Filed: Sep. 17, 2012

(65) Prior Publication Data

US 2013/0098256 A1 Apr. 25, 2013

Related U.S. Application Data

(60) Provisional application No. 61/535,338, filed on Sep. 15, 2011.

(51) Int. Cl.

| | |
|---|---|
| ***B41F 31/02*** | (2006.01) |
| ***B41F 17/22*** | (2006.01) |
| ***B41F 31/00*** | (2006.01) |
| ***B41F 33/02*** | (2006.01) |

(52) U.S. Cl.

CPC ..... *B41F 31/002* (2013.01); *B41F 17/22* (2013.01); *B41F 31/02* (2013.01); *B41F 33/02* (2013.01)

(58) Field of Classification Search

CPC ..... B41F 31/002; B41F 13/22; B41F 17/22

USPC ..... 101/348, 349.1, 487

See application file for complete search history.

(56) References Cited

U.S. PATENT DOCUMENTS

| | | | | |
|---|---|---|---|---|
| 6,466,743 | B2 * | 10/2002 | Nakagishi et al. | 396/150 |
| 6,854,658 | B1 * | 2/2005 | Houghton | F16K 11/0746 137/625.41 |
| 7,243,901 | B2 * | 7/2007 | Eggleston | F16K 1/2263 251/180 |
| 7,347,899 | B2 * | 3/2008 | Day | 118/667 |
| 8,479,650 | B2 * | 7/2013 | Peter | 101/487 |
| 8,567,316 | B2 * | 10/2013 | Hieronymus et al. | 101/487 |

* cited by examiner

*Primary Examiner* — Jennifer Simmons
*Assistant Examiner* — Leo T Hinze
(74) *Attorney, Agent, or Firm* — Young Basile Hanlon & MacFarlane, P.C.

(57) ABSTRACT

A modular decorator ink temperature control system for use with a blanket wheel, the blanket wheel having inker station configured with an inker station panel and at least one roller operatively mounted thereto. The modular decorator ink temperature control system includes a thermal transfer fluid conduit having an entry end distal to the blanket wheel and an exit end proximate to the blanket wheel with the thermal transfer fluid conduit in contact with the at least one roller and configured to convey at least one thermal transfer fluid therethrough. The modular decorator ink temperature control system also includes at least one control manifold device mounted on the inker station panel in operative communication with the thermal transfer fluid conduit.

14 Claims, 10 Drawing Sheets

DECORATOR INKER STATION TEMPERATURE CONTROL SYSTEM

CROSS-REFERENCE

This application claims priority benefit to U.S. Provisional Patent Application Ser. No. 61/535,338 filed Sep. 15, 2011, which is incorporated herein by reference in its entirety.

BACKGROUND

The present invention relates to decorators used to apply ink to containers including but not limited to cans, plastic containers and the like. More specifically, the present invention relates to a system and method for controlling the temperature of ink used in a decorator.

Cylindrical containers such as cans are often decorated using ink applied by high speed machines called decorators. The decorators can operate at high speeds and can be configured to process over 2000 objects per minute. As such, they are configured to apply a multi-color ink pattern or print image having two or more colors by rotating the cylindrical container past a printing blanket loaded with ink.

Typical decorators have a number of mandrels arrayed on the periphery of a mandrel wheel. The mandrels are each configured to support an individual object such as a can so that the objects can continually rotate around the axis of the mandrel wheel. The mandrel wheel turns in coordination with a blanket wheel that is configured with a number of printing blankets arranged around the periphery of the blanket wheel to engage the objects positioned on the mandrels located on the mandrel wheel. Each printing blanket rotates past one or more inker rolls to pick up a volume of ink with each individual inker roll, applying a different color ink based upon the desired final print image.

After the printing blanket has been inked, the printing blanket rotates past and contacts an object to transfer the ink image to the object's surface. The mandrel wheel can advance the object past additional printing blankets to impart the decorated surface as desired or required. Once the design has been printed on the object, the object can be advanced to suitable post-printing processing stations such as varnishing and curing operations. The printing blanket(s) continue to rotate with the associated blanket wheel and the process can be repeated on subsequent objects.

The various printing blanket(s) are supplied with ink in a continuous repeatable manner. In certain devices, each inker device contains a number of rollers that transfer ink from an ink reservoir such as an ink tray or ink fountain to the printing blanket located on the blanket wheel. Eventually the ink is transferred to a suitable printing plate cylinder.

One challenge associated with using decorators operating at high speeds is maintaining the ink at proper temperature. In order achieve successful high-speed ink application, each individual ink composition should be maintained within an optimum temperature range. Deviation outside this prescribed optimum temperature range can alter physical and/or chemical properties of the ink composition can result in improper image transfer. For example, elevated ink temperature can lead to volatilization of ink components of the ink that can alter the ink chemistry. Similarly application temperatures below optimum can alter the viscosity of the composition of one or more or the constituent parts of ink. Temperatures that are below optimal can result in phenomena such as misting or slinging. Temperature variations can lead to changes in color hue and intensity. Temperature changes can also lead to improper or irregular deposition of ink material including but not limited to runs bleeds and the like.

Image transfer difficulties can occur at system startup or restart as the various inks are brought to temperature. Other difficulties are encountered during system operation. During prolonged high-speed operation, temperatures of the various component parts of the applicator as well as the associated inks can exceed optimum recommended application temperatures. The application temperatures of the various inks can also be affected by fluctuations in surrounding ambient temperature in certain applications.

Various temperature control systems have been proposed to minimize the amount of time that the temperature of the ink is outside the desired temperature range. These systems provide a central ink temperature conditioning system composed of a central recirculation loop that is configured to recirculate a temperature conditioning solution and a feeder line that controls the flow of the temperature conditioning solution and delivers it to a remote location located on at least one ink roller on a decorator. The system is configured to deliver temperature conditioning solution that includes a dedicated a heating solution or a dedicated cooling solution to the plurality of ink rollers based on the detected temperature of the ink to be applied.

Such systems typically circulate water through the various rollers to control temperature and typically pass water through a rotary union into a bore prepared in a shaft that extends under the entire width of the associated roller. Holes bored through the shaft perpendicular to its axis near each end of the roller are intended to allow the water to flow through the hollow body of the roller to transfer heat away from the associated assembly. Water circulation is controlled via a pump located remote from both the circulation conduits and the printing blanket(s).

Heretofore the various systems required large control loops and operated on a manually controlled duty-cycle model. It would be desirable to provide a system that provides an automated system that provides a closed loop system that is feedback controlled and is proximate to the inker. It would also be desirable to provide a modular decorator temperature control system that allows the temperature of the ink being applied to a container to be accurately controlled in a small, easy-to-install interface mounted directly to the inker station providing local control of temperature at the point of use.

SUMMARY

A modular decorator ink temperature control system for use with a blanket wheel, the blanket wheel having an inker station configured with an inker station panel and at least one roller operatively mounted thereto. The modular decorator ink temperature control system includes a thermal transfer fluid conduit having an entry end distal to the blanket wheel and an exit end proximate to the blanket wheel with the thermal transfer fluid conduit in contact with at least one roller and configured to convey at least one thermal transfer fluid therethrough. The modular decorator ink temperature control system also includes at least one control manifold device such as a temperature control module mounted on the inker station panel in operative communication with the thermal transfer fluid conduit.

BRIEF DESCRIPTION OF THE DRAWINGS

The various features, advantages and other uses of the present apparatus will become more apparent by referring to the following detailed description and drawing in which.

DETAILED DESCRIPTION

Figure 1A:
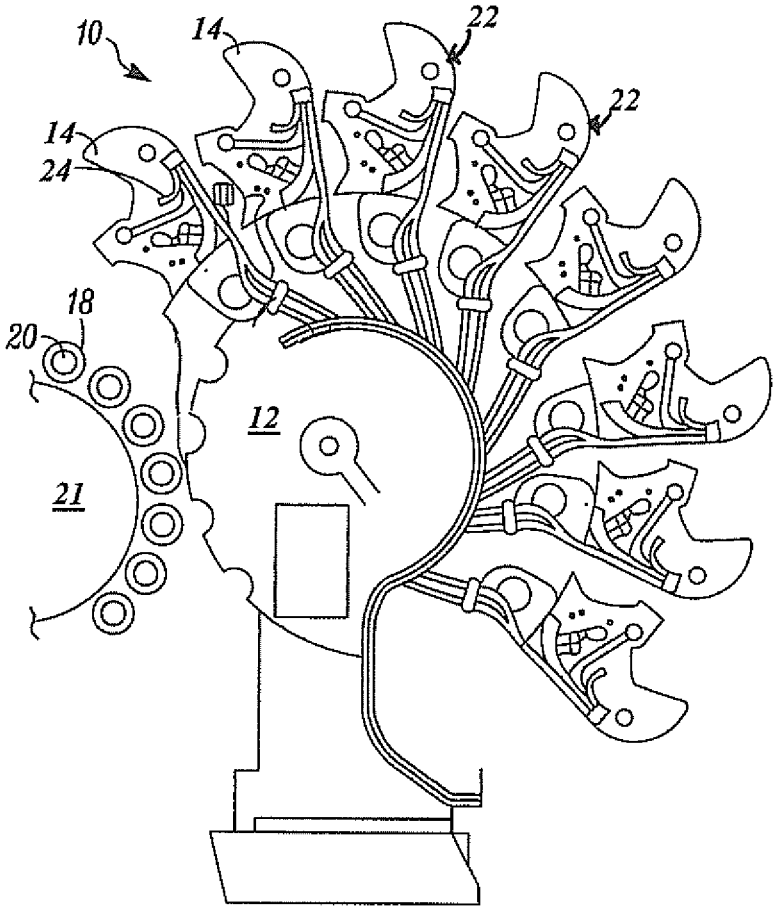
FIG. 1A PRIOR ART
FIG. 1A is an elevation view of a portion of a prior art temperature control system attached to a decorator.
Figure 1B:
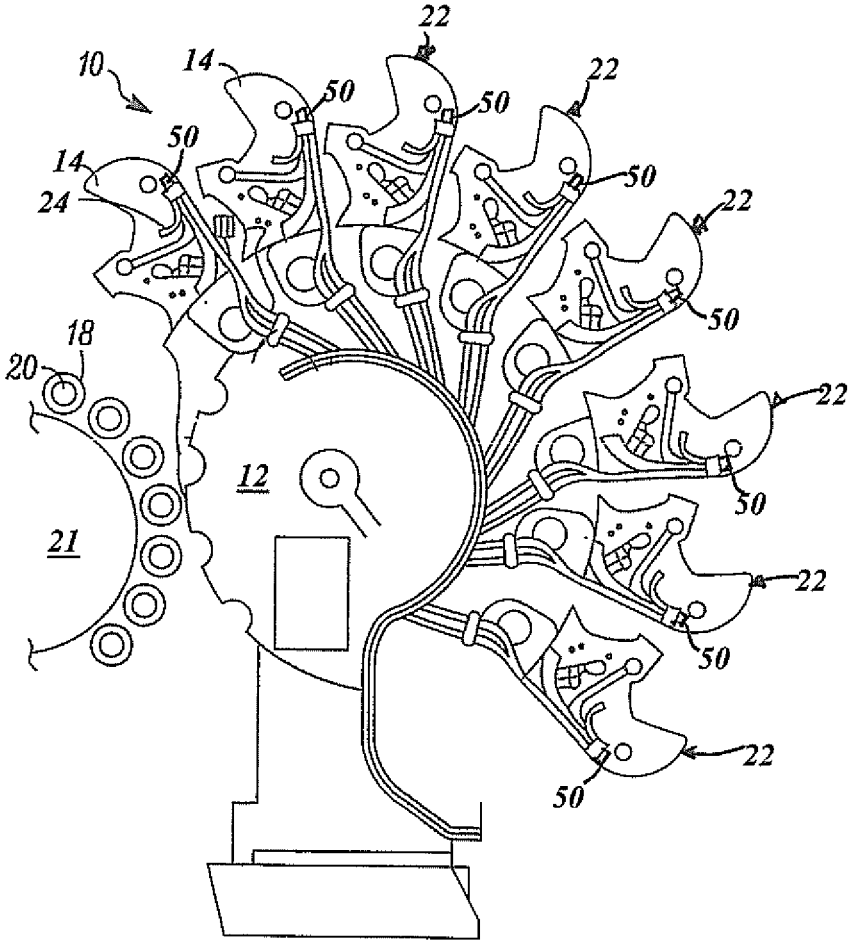
FIG. 1B is an elevation view of a portion of a temperature control system as disclosed herein attached to a decorator.

Referring to FIG. 1B, disclosed herein is a temperature control system for a decorator inker station associated with a suitable decorator system 10 for applying printed indicia to suitable objects such as cans and the like. The decorator inker station is typically composed of a blanket wheel 12 that has multiple inking blankets 14 disposed in spaced relationship around the outer circumference of the blanket wheel 12. Cans 18 to be imprinted are held in position on associated mandrels 20. The mandrels 20 are positioned in spaced relationship about a mandrel wheel 21 located in spaced but operatively engaging position relative to the blanket wheel 12. The blanket wheel 12 and mandrel wheel 21 rotate in opposed relation to one another and are oriented such that the cans 18 engage the inking blankets 14 on rotating the blanket wheel 12 transferring ink the surface of the respective cans 18.

Figure 2:
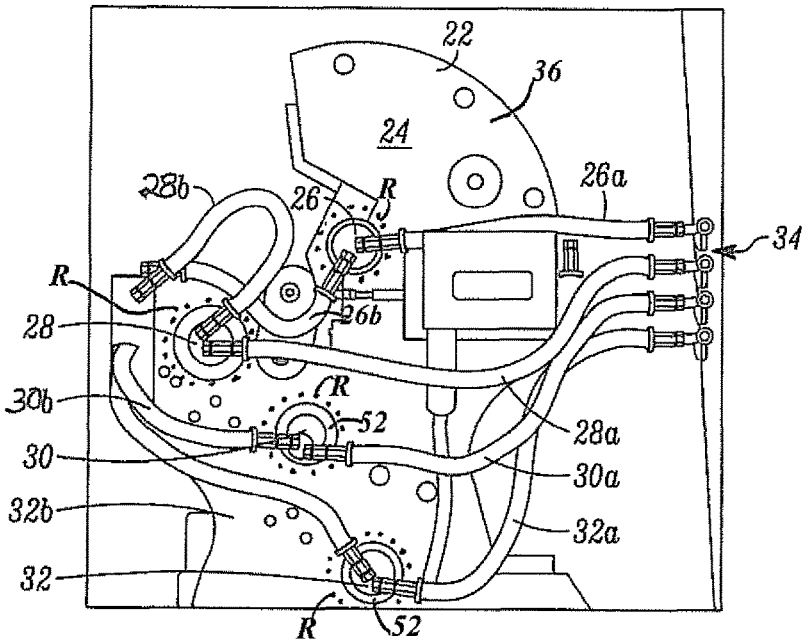
FIG. 2 is a perspective view of a portion of a decorator with an embodiment of a decorator inker station temperature control system as disclosed herein.

The blanket wheel 12 is composed of one or more temperature-controlled inker station(s) 22 located round the periphery of the blanket wheel 12 and generally projecting therefrom. The inker station(s) 22 supply a specific ink to the various inking blankets 14. An inker station as disclosed herein is depicted in FIG. 2. Each inker station 22 includes one or more inker rollers R shown in phantom in FIG. 2 that distribute and transfer ink from a suitable ink supply or tray (also not shown) to respective inking blankets 14 or the blanket wheel 12. The inker rollers R are mounted to a suitable support such as an inker station frame plate such as panel 24 and connected to suitable communication fittings. In the embodiment depicted in FIG. 2, the inker station 22 is configured with four inker rollers R connected to four respective communication fittings 26, 28, 30, 32.

The communication fittings 26, 28, 30, 32 each communicate with an associated thermal fluid conditioning supply conduit and a thermal conditioning fluid discharge conduit. In the embodiment depicted in FIG. 2, the various four communication fittings 26, 28, 30 and 32 each have a supply line 26*a*, 28*a*, 30*a*, and 32*a* associated with them as well as a suitable fluid discharge conduit 26*b*, 28*b*, 30*b* and 32*b*

As disclosed herein, the decorator system 10 has at least one temperature conditioning decorator inker station 22 including a plurality of inker rollers R that are configured to distribute ink in a defined ink temperature range. At least one decorator inker station 2 can be configured to accomplish ink temperature control and regulation utilizing a suitable temperature conditioning fluid passage system. As disclosed herein one or more inker stations 22 can be configured with an ink temperature control system that is mounted on the associated inker station panel 24 of the decorator inker station 22. As such, where desired or required, one or more of rollers can be configured to permit the passage of thermal conditioning fluid through the interior region of the roller. The various communication fittings 26, 28, 30, 32 can be configured to communicate with through-passages defined in each respective roller R to permit transit of thermal conditioning fluid into and out of the associated roller. In the embodiment depicted in FIG. 2, the communication fittings 26, 28, 30, 32 are standard rotary union fittings configured such that the thermal conditioning fluid feeds into the roller through the center of the fitting and out through the peripheral region.

Thermal conditioning fluid can be conveyed to each inker station 22 from a thermal conditioning fluid source via a suitable conduit such as supply line 28*a* and can be removed from each inker station 22 by means of a suitable conduit such as fluid discharge conduit 28*b*. In the embodiment depicted, thermal conditioning fluid is delivered to each roller R in parallel. Other configurations are also contemplated. Systems can be configured in series or in parallel.

The decorator inker station temperature control system as disclosed herein includes at least one temperature control module 34 that is located proximate to an associated individual inker station 22. The temperature control module 34 is configured to regulate the supply of thermal conditioning fluid and thereby regulate the temperature of ink being dispatched from the inker station 22 to the inking blankets 14 in response to certain command and control inputs. The temperature control module 34 can act on either the supply side or the exit side of the inker station thermal conditioning system as desired or required.

Figure 3:
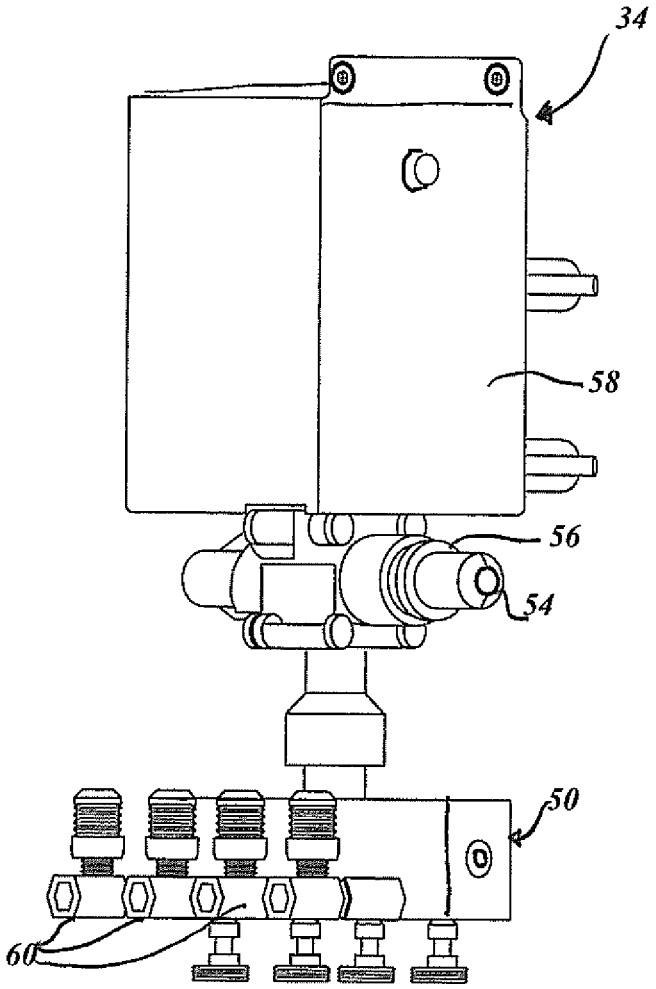
FIG. 3 is a plan view of an embodiment of a manifold and controller as depicted in FIG. 1.
Figure 4:
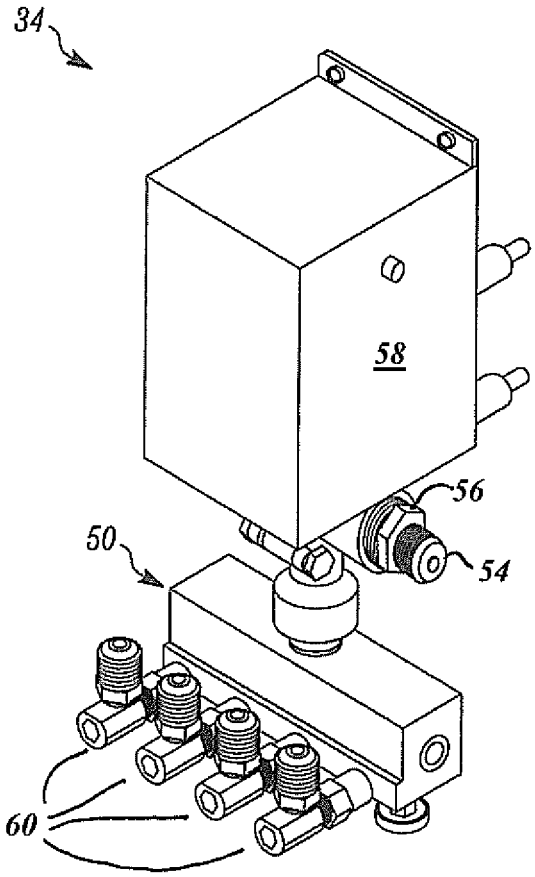
FIG. 4 is a perspective view of the manifold and controller.

In the embodiment depicted in FIGS. 3 and 4, the temperature control module 34 is composed of a modulating balance supply manifold 50 that communicates with at least one of the individual ink rollers and to regulate flow of thermal conditioning fluid passing through the ink roller to a flow rate proportional to the temperature conditions of the specific ink roller or rollers associated with the specific inker station 22. The inker temperature control module 34 is located proximate to the rollers and associated communication fittings 26, 28, 30, 32 located on the inker station 22. In the embodiment depicted in FIG. 2, the inker temperature control module 34 is mounted on one face 36 of the inker station panel 24 with the various ink rollers R shown in phantom and project from the opposed face.

Figure 7:
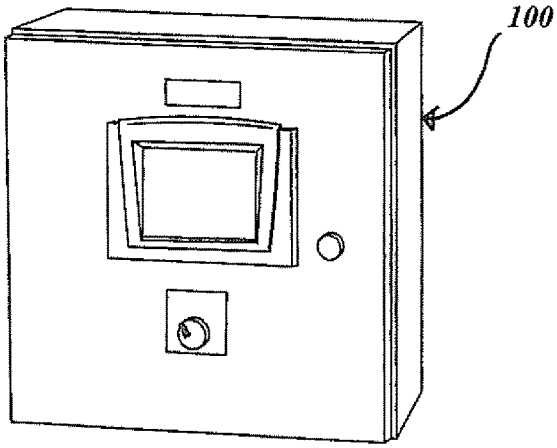
FIG. 7 is a plan view of an embodiment of a host controller module that can be used with the device disclosed herein.

The modulating balance supply manifold 50 is configured to regulate flow of the thermal conditioning fluid though the various rollers R in response to suitable command inputs. The modulating balance supply manifold 50 as disclosed herein can include an interface that can communicate with a suitable master control center module 100 as depicted in FIG. 7. The master control module 100 can be centrally located and configured with suitable operator communication and connection to the line PLC if desired or required.

In the embodiment disclosed, the master control center module 100 is configured to receive various operational data from various locations on the decorator device 10 and to formulate operational commands that can be promulgated to modulating supply manifold(s) located on one or more of the inker stations 22, either independently or in coordination with one another. The operational data can be derived from various sources including, but not limited to, temperature sensors associated with one or more rollers on a given inker station 22. A non-limiting example of suitable temperature sensors are depicted in FIG. 2 and include dedicated non-contact temperature sensors 52 such as IR sensor(s) mounted on the inker station panel 24 or other suitable location. In various embodiments, the IR sensor can be configured to monitor the temperature of any of the various rollers; one non-limiting example would be monitoring the temperature of the lower oscillating roller. It is contemplated that the data derived from sensors such as the sensor(s) 52 can be used to coordinate the operation one or more of the of the modulating balance supply manifolds 50 on one or more of the inker stations 22 in order to perform the temperature control function in response to feedback.

In the certain embodiments such as an embodiment disclosed herein, the master control center module 100 can have operating parameters suitable for use in the application specified. For example, the modulating balance supply manifold 50 can operate on 90-240V 50/60 Hz 1 ØAC power with a control voltage of 24 VDC. The master control center module 100 can have suitable connection means to establish electronic connectivity with modulating balance supply manifold 50.

Where desired or required, the multiple inker stations 22 each can be equipped with the decorator temperature control system 34 as disclosed herein. The configuration disclosed herein permits temperature control tailored to the desired parameters of each ink to be administered or applied.

An embodiment of the modulating balance supply manifold 50 is illustrated in FIG. 2 and FIG. 3. A modulating balance supply manifold 50 is positioned at one or more inker stations 22 in the manner depicted in FIG. 2. The modulating balance supply manifold 50 is configured with mounting centers (not shown) configured to mount on a suitable face of inker station 22. Where desired or required, the modulating balance supply manifold 50 is configured to facilitate easy incorporation into the inker station 22.

The modulating balance supply manifold 50 is configured with at least one modulating valve 56 providing and regulating fluid flow and access through at least one water port 54. The manifold 50 has at least one on-board controller 58. The modulating valve can be an elliptical modulating valve, if desired. Water conveyed through the modulating valve 56 such as an elliptical modulating valve passes through a plurality balancing valves 60.

In operation, the controller in the inker control module adjusts the modulating valve 56 to regulate the volume of water supplied to the rollers R. The balancing valves 60 set the ratio of the total volume that is sent to each roller R so as to individually control the temperature of that specific roller R relative to the-rollers. This allows the thermal profile of the inker station 22 to be easily manipulated to produce optimum ink pull-down and distribution, then apply it to the individual cans 18 at the proper temperature to produce perfect color every time. The operating temperature, determined to be that of one of the various rollers R, is set at the controller and can be adjusted to strike a balance between color, pull-down, misting and slinging, solvent evaporation, etc. In certain embodiments, the operating temperature is set at the first oscillating roller.

The decorator inker temperature control system can be configured to convey and regulate the flow of either chilled or heated thermal conditioning fluid such as water. It is also within the purview of this disclosure that the device be configured to convey and circulate both heated and cold water. This can be accomplished by providing the modulating inlet port with multiple water inlet ports that can communicate with a cold water source and a heated water source respectively.

Figure 5:
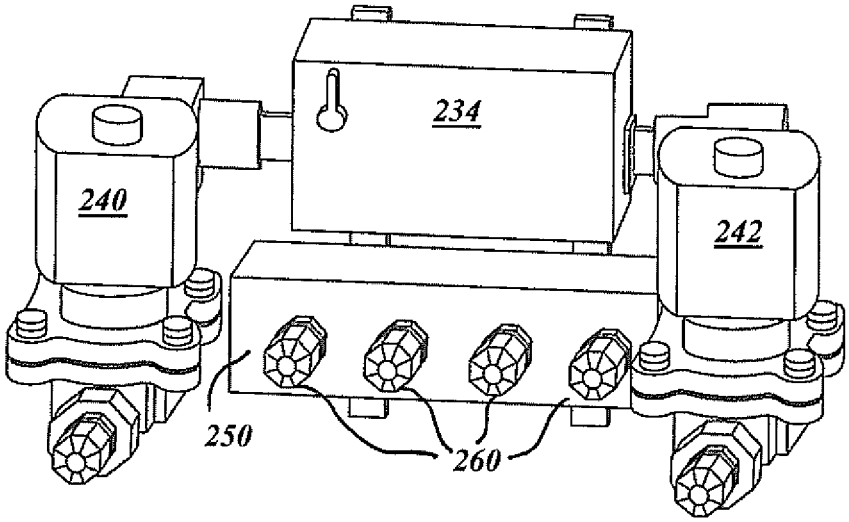
FIG. 5 is a plan view of an embodiment of a hot/cold selection manifold that can be used with the device of FIG. 1.
Figure 6:
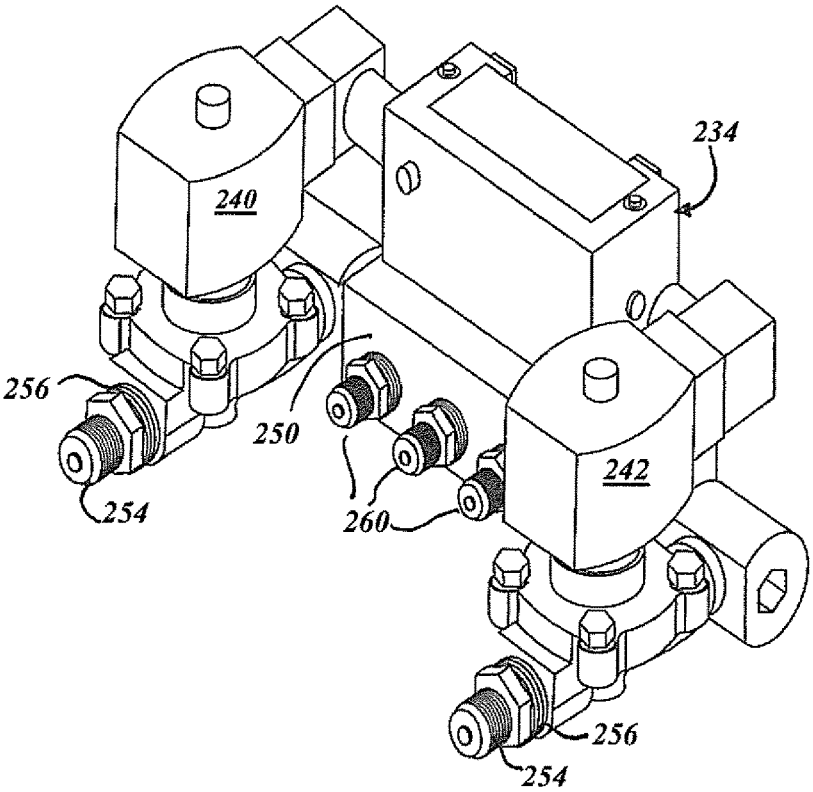
FIG. 6 is a perspective view of the device of FIG. 5.

In systems utilizing heated and cold water for temperature conditioning, the decorator inker temperature control system that is associated with the decorator system 10 can also include a heat/cool selection manifold. One embodiment of a heat/cool selection manifold is illustrated in FIGS. 5 and 6 at reference numeral 250. As depicted, the heat/cool selection manifold 250 is used only with heat/cool systems and determines whether the water being circulated through the inker flows from the warm water supply to the warm water return or from the cold water supply to the cold water return. The system can include inker temperature control module 234 with separate entries 240 and 242 for hot and cold water respectively with suitable balancing valves 260. The respective entries 240 and 242 can be associated with suitable ports 254 and modulating valves 256. By separating these, mixing of the warm and cold water supplies is eliminated, assuring the most energy efficient operation possible. This also ties to the inker control module with a pre-assembled cable and is controlled automatically in conjunction with the modulating heat/cool balancing manifold.

Comparative Example I

It has been found that color quality of the applied ink varies with temperature of application. For example, color shifts can occur as a function of temperature. In many situations cooler ink temperature is equated to darker coloring and warmer ink application temperatures equating to lighter color. Temperature variation alters viscosity of the ink applied. When ink is too cool, the ink can glob and get stringy due to increased viscosity. Additionally, if the ink at the fountain is too cold the ink may not "pull down" to the other rollers properly. If ink gets too warm, the elevated temperatures can drive off solvent that can alter ink performance. Variations in ink temperature at application can also result in slinging and misting of the ink. This can create clean up challenges and, if overly excessive, can also result in plant health and safety concerns.

Figure 8:
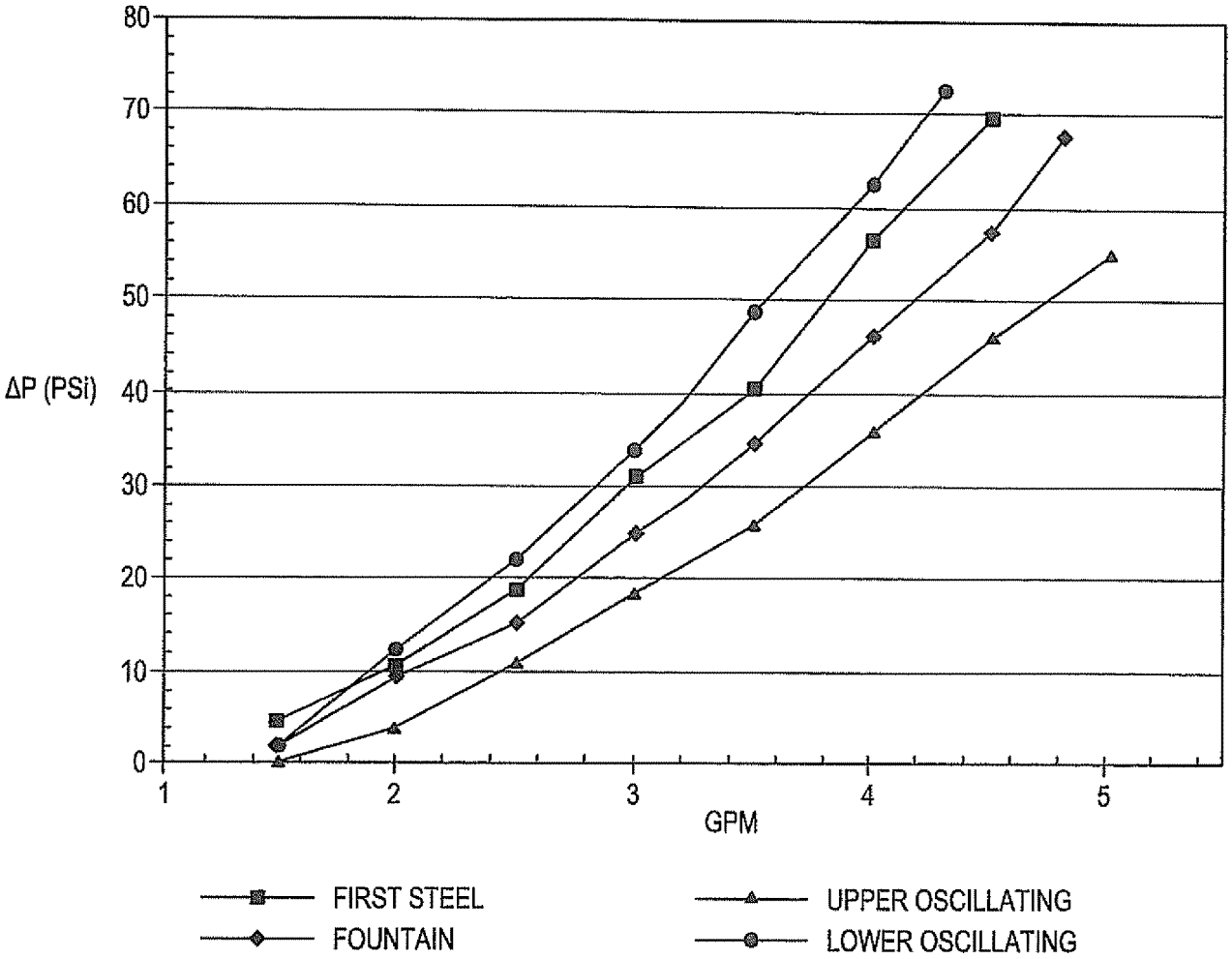
FIG. 8 is a graph depicting flow versus pressure for four rollers in an inker device.
Figure 9:
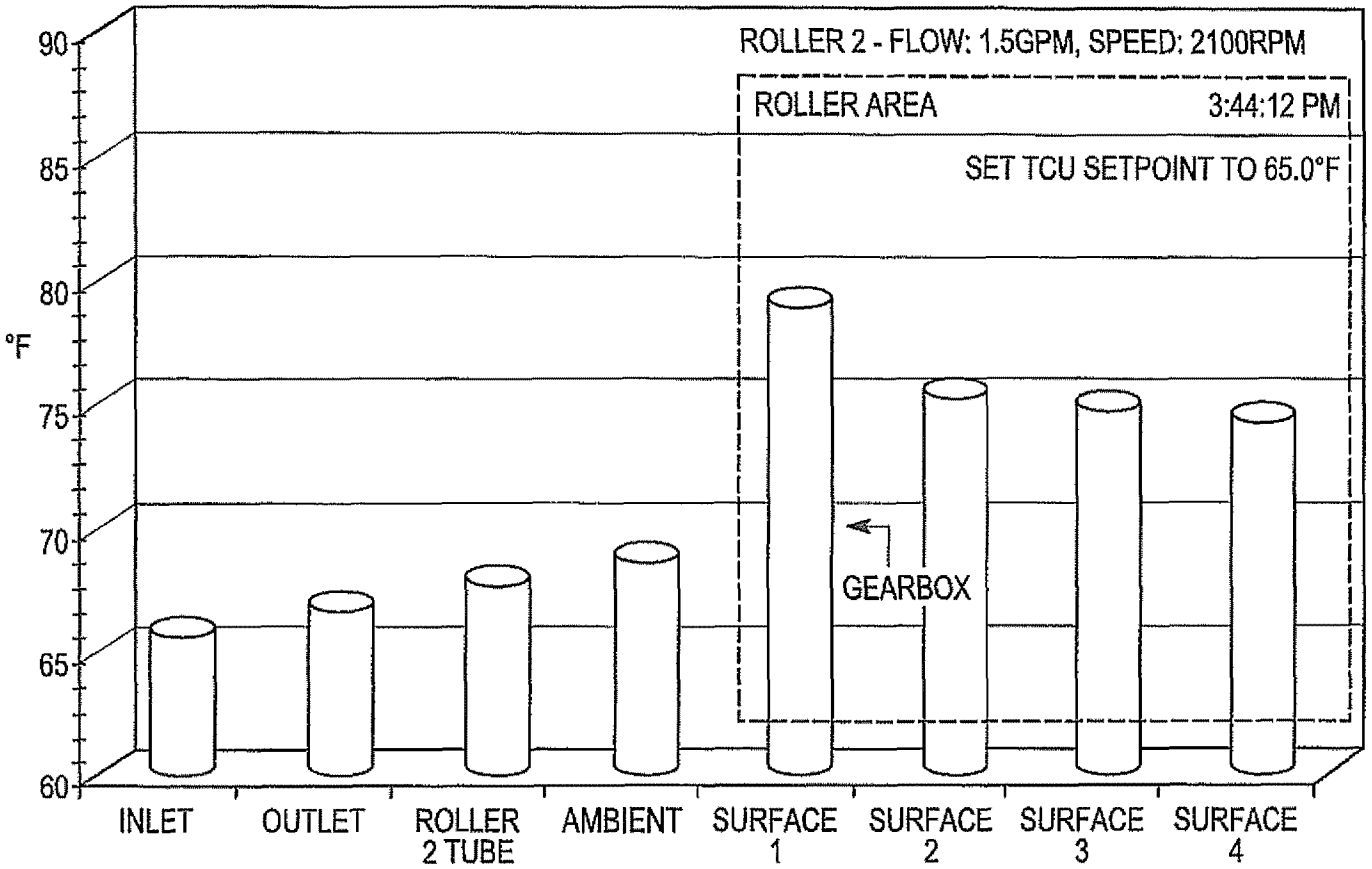
FIG. 9 is a graph depicting roller thermal gradient.
Figure 10:
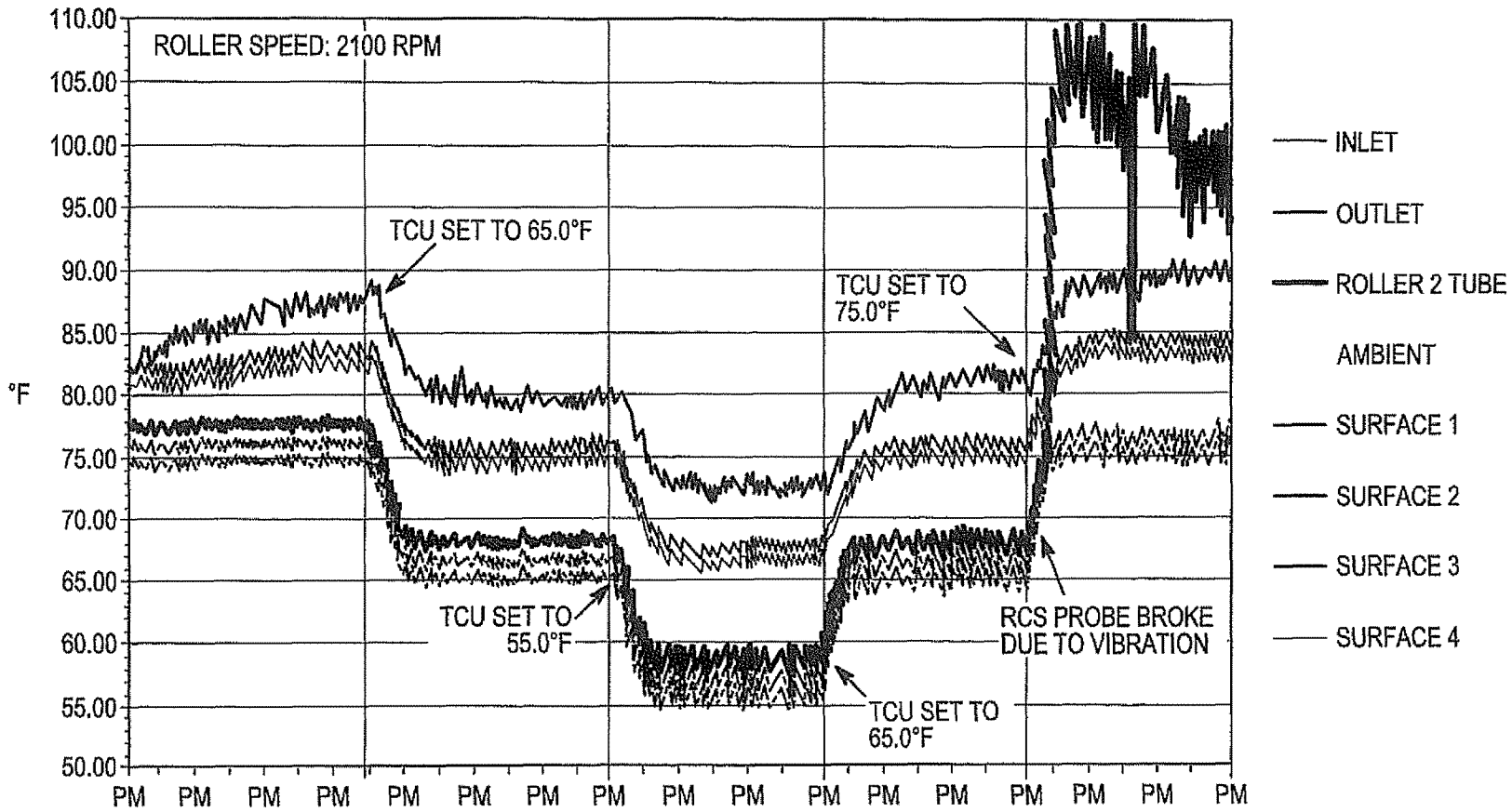
FIG. 10 is a graph depicting a typical roller temperature profile.

With a few qualifiers, the ability to cool is directly proportional to the volume of water that can be passed across the roller surface in a given period of time. In our examination of this system we found several issues each of which can result in a restriction of the flow through the roller and thus a limitation to the cooling capacity of the system. Flow versus pressure for four rollers in an inker is illustrated in the graph of FIG. 8. Maximum possible flow possible with traditional water supply systems determines the cooling capacity available in the fountain, first steel, upper oscillating roller and lower oscillating roller. Roller thermal gradient is depicted in the graph in FIG. 9, with ambient, roller tube, inlet and outlet temperatures depicted and compared to surface areas temperatures. A typical roller temperature profile is depicted in FIG. 10 illustrating temperature variation over time for the measurement points depicted in FIG. 9.

Many of these systems are cooled with city water which is generally supplied at 30-80 PSI depending on usage, location with respect to the nearest pumping station, demand on the rest of the system supplied by that pumping station, etc. This can vary by season, time of day, pump condition, etc. Though many plants have a booster pump on their system, most will still be limited to a maximum pressure of 60-80 PSI. The actual pressure available to the decorator is determined by its distance from the source as well as the size of the pipe between the two and the flow being supplied. From this it is clear that for any given pressure, the flow through each roller will be different and therefore the cooling capacity for that roller will be different. This differential becomes more pronounced as the flow requirements (read: cooling) increase and therefore some kind of balancing system is required and has thus been incorporated into the temperature control system design.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A modular decorator ink temperature control system for use with a blanket wheel, the blanket wheel having at least one inker station configured with an inker station panel and a first roller and a second roller each operatively mounted on the inker station panel, the modular decorator ink temperature control system comprising:

a first thermal transfer fluid conduit having an entry end a distal to the blanket wheel and an exit end proximate to the blanket wheel, the first thermal transfer fluid conduit configured to convey at least one thermal transfer fluid therethrough; and at least one temperature control module mounted directly on the inker station panel, the at least one temperature control module comprising:

an on-board controller, a first thermal transfer fluid entry port, a first modulating valve located downstream of the first thermal transfer fluid entry port, a modulating balance supply manifold located downstream of the first modulating valve, and a first balancing valve and a second balancing valve each located downstream of the modulating balance supply manifold, the modulating balance supply manifold positioned on the inker station panel, the modulating balance supply manifold in operative contact with the on-board controller of the temperature control module and the first and second balancing valves, wherein the distal end of the first thermal transfer fluid conduit is coupled to the first balancing valve and the proximate end of the first thermal transfer fluid conduit is coupled to the first roller such that first balancing valve and the first roller are in fluid communication, and wherein the first and second balancing valves are located upstream of first and second rollers.

2. The modulator decorator ink temperature control system of claim 1 wherein the temperature control module is positioned relative to the first thermal transfer fluid conduit at a location upstream of the first and second rollers.

3. The modulator decorator ink temperature control system of claim 2 wherein the first modulating valve comprises an elliptical modulating valve.

4. The modulator decorator ink temperature control system of claim 3 wherein the elliptical modulating valve is in operative contact with the on-board controller.

5. The modulator decorator ink temperature control system of claim 1 further comprising:

at least one sensor mounted on either the inker station panel or at least one of the first and second rollers; and a master controller located distal to the at least one temperature control module, the master controller operatively connected to the at least one temperature control module, the master controller configured to produce at least one command operative on the temperature control module in response to at least one input from the at least one sensor.

6. The modulator decorator ink temperature control system of claim 5 wherein the master controller is located upstream of the at least one temperature control module, wherein the at least one temperature control module further comprises:

a second thermal transfer fluid entry port; and a second modulating valve, wherein the second modulating valve is downstream of the second thermal transfer fluid entry port, wherein the first and second thermal transfer fluid entry ports are located on the inker station panel, the first thermal transfer fluid entry port is in fluid communication with a first conduit conveying thermal control fluid away from the first roller, and the second thermal transfer fluid entry port is in fluid communication with a second conduit conveying thermal control fluid away from the second roller.

7. The modulator decorator ink temperature control system of claim 5 wherein the temperature control module further comprises:

a second thermal transfer fluid entry port; and a second modulating valve, wherein the second modulating valve is downstream of the second thermal transfer fluid entry port, wherein the first and second thermal transfer fluid entry ports are located on the inker station panel, the first thermal transfer fluid entry port is in fluid communication with a first conduit conveying thermal control fluid away from the first roller, and the second thermal transfer fluid entry port is in fluid communication with a second conduit conveying thermal control fluid away from the second roller.

8. The modulator decorator ink temperature control system of claim 1 further comprising:

a second thermal transfer fluid conduit, the second thermal-transfer fluid conduit having a distal end coupled to the second balancing valve and a proximate end coupled to the second roller such that the second balancing valve and the second roller are in fluid communication, wherein the at least one temperature control module is in operative communication with the first thermal transfer fluid conduit and the second thermal transfer fluid conduit.

9. The modular decorator ink temperature control system of claim 8 wherein the temperature control module further comprises:

a second thermal transfer fluid entry port; and a second modulating valve, wherein the first and second modulating valves are elliptical modulating valves.

10. The modulator decorator ink temperature control system of claim 1 wherein the first modulating valve is an elliptical valve.

11. A modular decorator ink temperature control system for use with a blanket wheel, the blanket wheel having at least one inker station configured with an inker station panel and at least a first roller and a second roller each roller operatively mounted on the inker station panel, the modular decorator ink temperature control system comprising:

a thermal transfer fluid conduit having an entry end distal to the blanket wheel and an exit end proximate to the blanket wheel, the thermal transfer fluid conduit configured to convey at least one thermal transfer fluid therethrough;

at least one temperature control module mounted directly on the inker station panel, the at least one temperature control module comprising:

an on-board controller, a first thermal transfer fluid entry port and a second thermal transfer fluid entry port each in operative contact with the temperature control module, a first modulating valve and a second modulating valve each in operative contact with the temperature control module, wherein the first modulating valve is downstream of the first thermal transfer fluid entry port and the second modulating valve is downstream of the second thermal transfer fluid entry port;

at least one modulating balance supply manifold located downstream of the first and second modulating valves, a first balancing valve and a second balancing valve each located downstream of the modulating balance supply manifold, the modulating balance supply manifold positioned on the inker station panel, the modulating balance supply manifold in operative contact with the on-board controller of the temperature control module and the first and the second balancing valves, at least one sensor operable to detect temperature data associated with at least one of the first and second rollers, and a master controller located distal to the at least one temperature control module, the master controller operatively connected to the at least one temperature control module, wherein the first and second modulating valves are in operative contact with the master controller, and wherein the temperature control module is mounted on the inker station panel at a location upstream of the first and second rollers, and wherein the temperature data is transmitted to the at least one temperature control module from the at least one sensor, wherein the distal end of the thermal transfer fluid conduit is coupled to one of the first and second balancing valves and the proximate end of the thermal transfer fluid conduit is coupled to one of the first and second rollers such that the one of the first and second balancing valves and the one of the first and second rollers are in fluid communication, and wherein the first and second balancing valves are located upstream of the first and second rollers.

12. A modular decorator ink temperature control system for use with a blanket wheel, the blanket wheel having at least one inker station configured with an inker station panel and at least a first roller and a second roller each operatively mounted on the inker station panel, the modular decorator ink temperature control system comprising:

at least one thermal transfer fluid conduit having a distal end and a proximate end, the thermal transfer fluid conduit configured to convey at least one thermal transfer fluid therethrough;

at least one temperature control module mounted directly on the inker station panel, the at least one temperature control module comprising:

an on-board controller, a first thermal transfer fluid entry port, a first modulating valve located downstream of the first thermal transfer fluid entry port, wherein the first modulating valve is in operative contact with the temperature control module;

at least one modulating balance supply manifold located downstream of the first modulating valve, a first balancing valve and a second balancing valve each located downstream of the modulating balance supply manifold, the modulating balance supply manifold positioned on the inker station panel, the modulating balance supply manifold in operative contact with the on-board controller of the temperature control module and the first and second balancing valves, at least one sensor associated with either the blanket wheel or at least one of the first and second rollers; and a master controller located distal to at least one temperature control module, the master controller operatively connected to the at least one temperature control module, the master controller configured to produce at least one command operative on the modulating balance supply manifold in response to at least one input from the at least one sensor, wherein temperature data transmitted to the temperature control module is derived from at least one of the first or second rollers, wherein the distal end of the thermal transfer fluid conduit is coupled to one of the first and second balancing valves and the proximate end of the thermal transfer fluid conduit is coupled to one of the first and second rollers such that the one of the first and second balancing valves and the one of the first and second rollers are in fluid communication, and wherein the first and second balancing valves are located upstream of the at first and second rollers, and wherein the modulating balance supply manifold regulates flow of the thermal transfer fluid through at least one of the first and second rollers in response to the at least one command.

13. The modulator decorator ink temperature control system of claim 12 wherein the master controller is located upstream of the at least one temperature control module and wherein the at least one temperature control module further comprises:

a second thermal transfer fluid entry port; and a second modulating valve, wherein the first and second modulating valves are elliptical modulating valves, the first modulating valve is downstream of the first thermal transfer fluid entry port, and the second modulating valve is downstream of the second thermal transfer fluid entry port.

14. The modulator decorator ink temperature control system of claim 13 wherein the first thermal transfer fluid entry port is in fluid communication with a first conduit conveying thermal control fluid away from one of the first and second rollers and the second thermal transfer fluid entry port is in fluid communication with a second conduit conveying thermal control fluid away from the other of the first and second rollers.

* * * * *